US009981398B2

(12) United States Patent
Bohn

(10) Patent No.: US 9,981,398 B2
(45) Date of Patent: May 29, 2018

(54) TRANSFER/PUNCHING PROCESS

(71) Applicant: Bielomatik Jagenberg GmbH + Co. KG, Neuss (DE)

(72) Inventor: Martin Bohn, Reutlingen (DE)

(73) Assignee: BW Papersystems Stuttgart GmbH, Nuertingen (DE)

( * ) Notice: Subject to any disclaimer, the term of this patent is extended or adjusted under 35 U.S.C. 154(b) by 106 days.

(21) Appl. No.: 14/903,823

(22) PCT Filed: Jul. 8, 2014

(86) PCT No.: PCT/EP2014/064615
§ 371 (c)(1),
(2) Date: Jan. 8, 2016

(87) PCT Pub. No.: WO2015/018587
PCT Pub. Date: Feb. 12, 2015

(65) Prior Publication Data

US 2016/0151928 A1 Jun. 2, 2016

(30) Foreign Application Priority Data

Aug. 8, 2013 (DE) ..... 10 2013 215 706

(51) Int. Cl.

| | |
|---|---|
| ***B26D 7/01*** | (2006.01) |
| ***B26F 1/38*** | (2006.01) |
| ***B26D 3/08*** | (2006.01) |
| ***B26D 7/18*** | (2006.01) |
| ***B26F 1/44*** | (2006.01) |
| *B26F 1/40* | (2006.01) |

(52) U.S. Cl.
CPC ..... *B26D 7/018* (2013.01); *B26D 3/085* (2013.01); *B26D 7/18* (2013.01); *B26F 1/384* (2013.01); *B26F 1/44* (2013.01); *B26F 1/40* (2013.01); *B26F 2001/4436* (2013.01); *B26F 2001/4472* (2013.01)

(58) Field of Classification Search
CPC ..... B26D 7/018; B26D 3/085; B26D 7/18; B26F 2001/4436; B26F 2001/4472
USPC ..... 83/13, 111, 117, 118, 139
See application file for complete search history.

(56) References Cited

U.S. PATENT DOCUMENTS

| | | | | |
|---|---|---|---|---|
| 5,382,404 A | | 1/1995 | Kogame | |
| 5,788,999 A | * | 8/1998 | Mizuno | B26D 7/1863 425/302.1 |
| 5,810,233 A | * | 9/1998 | Varidel | B26D 7/1818 225/105 |
| 7,182,899 B2 | * | 2/2007 | Tanii | H01G 4/30 156/261 |

(Continued)

FOREIGN PATENT DOCUMENTS

| | | |
|---|---|---|
| DE | 202012011193 U | 4/2013 |
| GB | 1436544 A | 5/1976 |

*Primary Examiner* — Omar Flores Sanchez
(74) *Attorney, Agent, or Firm* — Andrew Wilford

(57) ABSTRACT

The invention relates to a method for operating a punching/transferring device (1), in particular for producing RFID antennas. The punching/transfer device (1) has a punching tool (2) with a vacuum connection (3), said vacuum connection (3) interacting with a porous elastomer (9) such that by means of the punching tool (2), a desired contour can be punched out of a multilayer composite, held, and then dispensed by modifying the shape of the porous elastomer (9) and/or by modifying the vacuum.

12 Claims, 1 Drawing Sheet

(56) References Cited

U.S. PATENT DOCUMENTS

| | | | | |
|---|---|---|---|---|
| 8,371,509 | B2 | 2/2013 | Bohn | |
| 2011/0005821 | A1 | 1/2011 | Marttila | |
| 2016/0144528 | A1* | 5/2016 | Vasisht | A61K 9/006 514/279 |

* cited by examiner

TRANSFER/PUNCHING PROCESS

CROSS REFERENCE TO RELATED APPLICATIONS

This application is the US-national stage of PCT application PCT/EP2014/064615 filed 8 Jul. 2014 and claiming the priority of German patent application 102013205706.1 itself filed 8 Aug. 2013.

FIELD OF THE INVENTION

The invention relates to a punching and transferring device, as well as to a method of operating such a punching and transferring apparatus for making an RFID inlay.

BACKGROUND OF THE INVENTION

An apparatus and method for producing an RFID inlay are known. Such inlays comprise a substrate, for example a film made of PET, an antenna on the substrate and made of punched or etched aluminum, and a chip with a functional connection to the antenna.

Normally, such an inlay is installed in a label, fabric tag, or paper ticker as a layer—that is, the end product, which is also called a smart label, smart tag, or smart ticket, has three layers, in particular the printed or unprinted cover material, the inlay, and the printed or unprinted substrate.

WO 2009/118455 [US2011/0005821] describes a method of making an inlay antenna directly on paper by gluing the full surface of a metal film to a substrate web that has previously been coated with glue in the exact shape, and then punching out the antenna shape with a laser without damaging the substrate web. Unlike in the case of label punch scrap that has a continuous grid structure that can be pulled away, the waste of the unneeded antenna shape that is not connected to the substrate web by the glue shape is made of individual, separated segments that must be collected and disposed of at great effort.

OBJECT OF THE INVENTION

As such, the problem addressed by the invention is that of creating a punching and transferring apparatus, as well as a method of operating such a punching and transferring apparatus that avoids the disadvantages described above. In particular, the manner of making the antenna and the application of the antenna to a target component, such as a printed paper web, as well as the disposal of the unneeded metal film parts of the antenna, should be simplified.

SUMMARY OF THE INVENTION

According to the invention, with respect to the punching and transferring apparatus for making RFID inlays, the punching and transferring apparatus has a punch with a vacuum connection that works together with a porous elastomer. A desired shape can be punched out of a multilayer laminate by the punch, and the desired punched shape is held by the vacuum for the purpose of producing a vacuum acting on the punched out part. After this punching process has occurred, it is possible that the desired punched shape is transferred to a target component. In the simplest case, this is, for example, a product such as a paper web printed on the reverse side, a package or the like for example onto which the punched shape is transferred. As an alternative, it can be contemplated that the punched shape is applied to a further substrate and there, for example, this punched shape is applied to the substrate after the other one, to thereby arrange a plurality of laminate layers that are punched with the desired shape, one after the other.

A multilayer laminate that is made of at least one substrate layer, one adhesive layer, and one metal layer that works together with same is punched out with the desired shape by the punch. In this process, it is important that only the metal layer and the adhesive layer that works together with it are punched out with the desired shape, and not the entire multilayer laminate. This is because, after the punching process, at least the metal layer and the adhesive layer attached thereto should remain in the punch. In order to do this, the vacuum connection is provided and holds the multilayer laminate in the punch. At the same time, it must be ensured (and most of all, with the highest precision) that the blade of the punch gives the metal layer and the attached adhesive layer the desired shape by punching out the shape therefrom, but not from the substrate layer. This is necessary because it should be removed following the punching, and the laminate formed by the metal layer and adhesive layer that was punched out should be preserved for subsequent processing and/or treatment. In order to apply the vacuum, generated by the vacuum connection, to the multilayer laminate, a porous elastomer is also included. This porous elastomer has, on the one hand, the advantage that the vacuum that generates suction to hold the multilayer laminate in the punch can act through it on the multilayer laminate over its surface area. On the other hand, due to a corresponding composition of the porous elastomer, particularly with respect to its thickness and material properties, in cooperation with the vacuum, the multilayer laminate is precisely, and most importantly with a defined orientation, sucked back into the punch, and/or the punch can function during the punching, in such a manner that at least the metal layer and the adhesive layer positioned thereon are punched out, but the substrate layer is not touched by the punch. As a result, the cooperation between the deformable, porous elastomer and the generated vacuum ensures that the multilayer laminate, made of at least one metal layer, adhesive layer, and substrate layer, is punched out in the punch and held in such a manner that, following the punching process, at least the metal layer, with its adhesive layer, remains in the punch, and the substrate layer, together with the unneeded layers of the multilayer laminate (that is, the processing waste, and particularly the punch scrap) can be removed. After the substrate layer is removed, the adhesive layer of the metal layer (for example an antenna or antenna structure) is exposed such that the metal layer can thereby be subjected to further processing via its adhesive layer. As such, it is very simple to produce an antenna for an RFID inlay, and this can particularly take place in mass production. For this purpose, in a further implementation of the invention, multiple punches are provided on a punching roll, distributed about the circumference thereof. In this way, the multilayer laminate can be punched by these punches arranged on the punching roll one after the other in a rotary manner, and the punched out shapes can be fed to a further processing step.

In a further implementation of the invention, the punch has a cutting angle ≤45°, preferably in the range from 30° to 35°. In this way, a precise shape can be made in an advantageous manner, such that the metal layer that later forms, for example, the antenna of the RFID inlay, is not only punched out with very high precision, but can also be held in the punch. This contributes to the holding performed by the vacuum. The punch flanks of the punch can be oriented symmetrically at an angle to the punching direction.

In a further implementation of the invention, one punch flank of the punch extends parallel to a punching direction (asymmetrically). As a result, the cut edge of the metal layer extends parallel to the punching direction. The advantage of this is that the punched out multilayer laminate made of at least one adhesive layer and metal layer is held in the punch in a defined orientation, in addition to the cooperation of the porous elastomer and the vacuum force that in this configuration compacts the porous elastomer. After the punching process is completed, the substrate layer can be removed, thereby first exposing the adhesive layer inside the axial extension of the punch flanks or inside the punch. In this condition, it is not possible—or not over the entire surface thereof—to use the adhesive layer for further processing. The vacuum force can then be removed, or at least reduced compared to the vacuum force previously applied, or can be maintained, such that the porous elastomer that was compressed during the punching process can only relax in a defined manner due to its elasticity (independently of the vacuum force). As a result, the plane in which the adhesive layer lies is moved out of the plane in which the end edge of the punch flanks lies. As such, the adhesive layer is freely accessible for further processing.

Until now, the multilayer laminate was a laminate made of a metal layer, an adhesive layer, and a substrate layer. Such a multilayer laminate is, for example, a paper-aluminum laminate (also called a PAL laminate). Depending on the form in which the punched out metal layer should be passed on to further processing, it may not be sufficient to give the metal layer with the attached adhesive layer the desired shape only by a punching process, as described above. For this reason, it can be contemplated that this multilayer laminate is attached to a further substrate layer, via a further adhesive layer. The multilayer laminate (for example, the PAL laminate) and the additional adhesive layer can therefore be punched out by the punch as a result of a corresponding shaping (particularly thickness) and corresponding material properties (particularly elasticity) of the porous elastomer, in conjunction with the vacuum force applied via the vacuum connection, the additionally attached substrate layer not being reached by the punch. In this case as well, after the vacuum force is reduced or removed, the porous elastomer pushes out the multilayer laminate that it previously held in the punching and transferring apparatus, such that the additional adhesive layer is exposed following the removal of the further adhesive layer, and this multilayer laminate can be transferred for further processing.

The following remarks are provided in general with respect to the vacuum force: the vacuum force substantially serves the purpose of holding the multilayer laminate inside the punch. It also causes a very minimal compaction of the porous elastomer, if at all. However, the porous elastomer is also substantially, or only, compressed by the forces produced by punching, and relaxes after the punching process entirely, or almost entirely, independently of the vacuum force.

For the purpose of reducing the per-unit cost of production of these products, and for a unified selection of materials with respect to environmental friendliness, it is both necessary and essential to the invention for the antenna to be constructed directly on the cover- or substrate web, and therefore advantageously enable a unified material selection and a reduction to two layers.

BRIEF DESCRIPTION OF THE DRAWING

The method according to the invention for operating a punching and transferring apparatus for making RFID inlays, and more precisely antennas of RFID inlays, is explained and described below in greater detail in the context of a punch used therefor according to the invention and with reference to a drawing in which.

SPECIFIC DESCRIPTION OF THE INVENTION

The punching and transferring apparatus 1 comprises a punch 2 that is either as a stand-alone tool or for example one of several such tools on a punching roll. The punch 2 has a vacuum connection 3 that makes it possible to generate a vacuum force applied to the back face of the punch 2 via this vacuum connection 3. This vacuum pressure can be modified in a controlled manner.

The punch 2 can impart to a multilayer laminate given a desired shape by punching.

Figure 1:
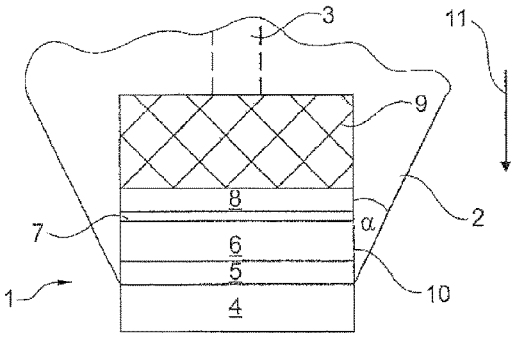
FIGS. 1 and 2 show a punching and transferring apparatus 1 at the moment of the punching process (FIG. 1) and at the moment of the transfer of the punched-out piece (FIG. 2) prior to release for further processing.
Figure 2:
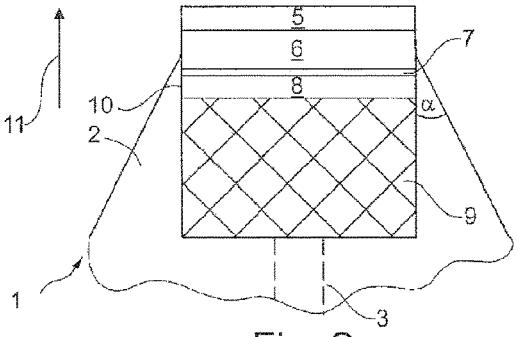

In the embodiment according to the processing steps illustrated in FIGS. 1 and 2, there is a multilayer laminate with a first substrate layer 4 carrying a first adhesive layer 5 that is connected to a second substrate layer 6. The second substrate layer 6, in turn, is provided with a second adhesive layer 7 over a large surface area, and a metal layer 8 is flush against the latter. The first substrate layer 4 is for example a silicone film, the second substrate layer 6 is for example made of paper, and the metal layer 8 is made of aluminum. This multilayer laminate can be realized in a particularly simple and cost-effective manner if the layers 6, 7, and 8 form the PAL laminate described above. This should be used cost-effectively from a roll.

The multilayer laminate 4-8 described above is fed to the punch 2. The punch is moved toward the first substrate layer 4, proceeding from the metal layer 8. It is specifically moved axially far enough that the shape of the punch 2 that is lowest when viewed as in FIG. 1 projects into the plane in which the first adhesive layer 5 lies, stopping at the upper face of the first substrate layer 4. For this purpose, the first substrate layer 4 can be supported on a counter support (for example, with a flat design, or as a backing roll). So that the punched-out piece formed only by the layers 5 to 8 is guided and held in the punch, the punch 2 has a punch flank 10 that advantageously runs parallel (asymmetrically) to a punching direction 11. The other punch flank of the punch 2 has an angle $\alpha$ that is preferably $\leq 45°$, and more preferably in the range from 30° to 35°. This design of the punch flank 10 results in a nearly right-angle punching shape with respect to the surface of the multilayer laminate. The two flanks of the punch can also be oriented symmetrically with respect to the punching direction 11.

In order to move the punched-out piece of this multilayer laminate in the punching direction 11 and also hold the piece in the punch 2, a vacuum force is effective through the vacuum connection 3 over a large portion of the surface of the metal layer 8 in this case via a porous elastomer. Because the first substrate layer 4 in particular is supported in a defined manner, and a defined vacuum force is also applied to the multilayer laminate, the porous elastomer 9 is compressed in a defined manner parallel to the punching direction 11. As a result, the multilayer laminate 5 to 8 is punched out in an advantageous manner by the punch flank 10 of the punch 2, and is held in the punch 2. Due to the material properties of the porous elastomer 9 and the applied vacuum force, the system ensures that the end of the punch flank 10 does not engage into the first substrate layer 4. Consequently, a piece of the desired shape is punched out of a multilayer laminate and held by the punch 2 and can then be released by modifying the shape of the porous elastomer 9, particularly its thickness, and/or by modifying the vacuum.

This transfer to a subsequent processing is achieved by pulling off the first substrate layer, for example the silicone film, following the punching process. In the process, the remaining layers 5 to 8 that lie outside of the shape of the punch 2 are also removed. It is important in this case that the adhesion forces of the adhesive layer 7 are significantly greater than those of the adhesive layer 5 in order to prevent the layers 6, 8 arranged on the first substrate layer 4 from also being pulled off with the same. As such, the punch 2 can perform not only the punching process, but also the transfer process for the further processing of the punched-out laminated piece.

Figure 3:
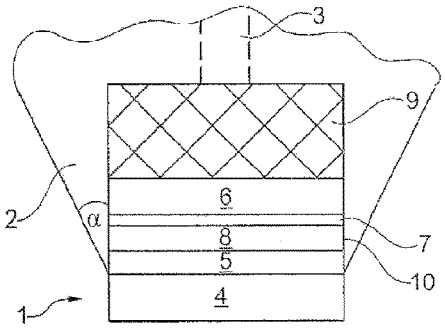
FIGS. 3 and 4 like FIGS. 1 and 2 show another punching tool and transferring apparatus according to the invention.
Figure 4:
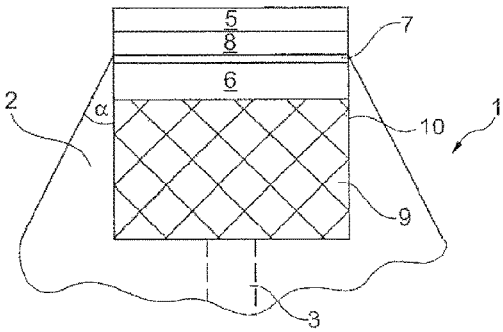

While FIGS. 1 and 2 show a first example for the multilayer laminate, the same process (punching and transfer) is likewise shown in FIGS. 3 and 4. However, in the latter case, the additional substrate layer 6 and the metal layer 8 are reversed relative to the adhesive layer 7. This can have significance for the subsequent processing of the punched-out laminated piece.

With respect to FIGS. 2 and/or 4, the actual transfer process is described below. After the multilayer laminate 5 to 8 has been punched out as in FIGS. 1 and 3, the first substrate layer 4 is removed in a subsequent step, along with the layers present around the punched-out piece. This leaves the metal layer 8 that has been given the desired shape and is connected to the further substrate layer 6 via the adhesive layer 7 inside the punch 2. In this case, this is the PAL laminate named above. However, this does not constitute a restriction, because other materials can also be used.

As shown in FIGS. 1 and/or 3, during the punching process this adhesive layer 5 lies approximately in the plane formed by the outer edges (the cutting edges facing downward in FIGS. 1 and/or 3) of the punch flanks 10. As such, at this time (that is, during and immediately following the punching), the adhesive layer 5 was not yet accessible in a defined manner for further processing. After the punching process, the porous elastomer 9 can relax in a defined manner (whereas previously the porous elastomer 9 was compressed in a defined manner during the punching process due to the shape of the punch 2). During the punching process, the vacuum force applied to the multilayer laminate positioned inside the punch 2 hold the punched-out piece in place. After the punching process, the vacuum force applied via the vacuum connection 3 is maintained, is reduced, and/or is eliminated. It is advantageous if it is maintained for the purpose of holding the multilayer laminate positioned inside the punch 2 and is now punched out. However, it can also be reduced or removed if the multilayer laminate is transferred to the target component directly after the punching process. In any case, it is important that the adhesive force of the adhesive layer 5 is greater than the holding force inside the punch so that the punched-out laminated piece can be removed from the punch by this adhesive force, and supplied to the target component and adhered to same.

As such, the porous elastomer 9 can therefore relax again in a defined manner following the punching process (because the counter support has been removed) such that it presses the punched multilayer laminate out of the punch 2 to a desired degree in a release direction 12. The degree of this pressing-out is chosen such that the entire adhesive layer 5, and optionally also a part of the second substrate layer 6, are preferably moved out of the plane defined by the lower edges of the punch flanks 10. This time following the reduction or removal of the vacuum force, and the relaxing of the porous elastomer 9 (that is, an enlargement of the axial extension in the release direction 12) is illustrated in FIGS. 2 and 4. After this has occurred, this punched-out laminated piece 5 to 8 can be transferred for further processing.

Figure 5:
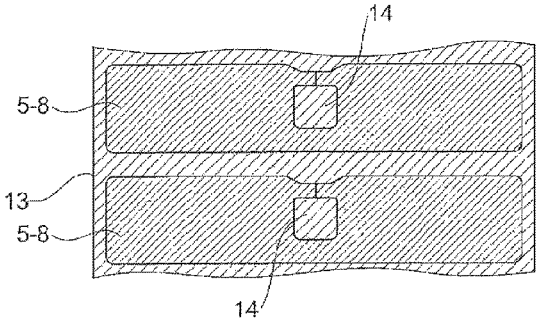
FIG. 5 is a top view of a finished workpiece in accordance with the invention.

Up to this time, most of the layers 5 to 8 of the multilayer laminate are inside the punch 2. However, because it may be necessary, particularly for making an antenna of an RFID inlay, to also give the metal layer 8 a desired shape, in one implementation of the invention it can be contemplated that a desired shape is made prior to the previously described process of punching out the metal layer 8, by a further, particularly upstream, process—particularly also a punching process. The desired shape can, for example, be a cutout 14 in the metal layer, or also a more complex geometry. The further, particularly upstream process need not necessarily be a punching process. Rather, it can be carried out by a laser or the like, for example. The desired overall shape to be given to the metal layer 8 is shown in FIG. 5 in a top view, and the layers 5 to 8 for example have been punched out as a multilayer laminate and transferred to a target component 13 (for example a paper web). Depending on the presence of more or fewer layers, accordingly more or fewer layers (for example only the metal layer with its adhesive layer) are transferred to the target component 13 following the punching process. As such, at least in one design, at least the metal layer 8 can therefore be given a desired shape, particularly a recess 14, before the multilayer laminate 4 to 8 is fed to the punch 2. In this way, the metal layer 8 is advantageously given the desired shape (for example, the antenna structure needed for an RFID inlay), and can undergo the further punching and transferring process. Particularly as regards the multilayer laminate 4 to 8 and the following punching and transferring process, the advantageous result, which is essential for the invention, is that for making an antenna for RFID inlay, an antenna structure is produced such that only the antenna structure, with its adhesive layer, need then be attached to the target component.

Therefore, this is an entirely decisive and substantial advantage of the punching and transferring apparatus according to the invention, and of the method carried out by same.

According to the invention, prior to the punching process, the second substrate layer 6 is furthermore detached from the first substrate layer 4, and then these two layers 4, 6 are brought back together again. In this way, the so-called release value between the two layers 4, 6 that are connected via the adhesive layer 5 is reduced. This means that to separate the two substrate layers 4, 6 from each other, a certain force must first be applied to overcome the adhesive forces of the adhesive layer 5 connecting together the two layers 4, 6. If at this point these two substrate layers 4, 6 are brought together again and then detached once more from each other, the release force then required is lower. This state is exploited to supply the multilayer laminate to the punching process in such a manner that lower forces are needed after punching to remove the first substrate layer 4 from the punched-out laminated piece. This is advantageous because as a result only reduced forces are required to hold the punched-out laminated piece 5 to 8 in the punch 2, particularly only the shape of the punch flanks 10 (and optionally without any vacuum). If the vacuum is present, it can be lower because the release value of the connection between the two substrate layers 4, 6 has been reduced by the previous detaching and re-attaching. This is advantageous most of all for mass production in the punching and transferring of the multilayer laminates.

According to the invention, as a complement to the above, the process of reattaching the two substrate layers 4, 6 can be performed with a matched superimposition or with an offset. If the process of reattaching the two substrate layers 4, 6 is performed with a matched superimposition, the release value is advantageously reduced as described above. If the process of reattaching the two substrate layers 4, 6 is performed with an offset, this has the advantage that the processing, by punching or otherwise, of the metal layer 8, which potentially reached into the direction of the first substrate layer 4, are no longer matched in superimposition following the attachment. As a result, it is advantageously possible to ensure that, if the metal layer 8 particularly has a delicate structure, for example that of an antenna, via the further processing, it can be removed during further processing, following the transfer from the first substrate layer 4, without incident—especially without damage.

Finally, the punched-out laminated piece comprising the substrate layer 6, the adhesive layers 5, 7, and the metal layer 8 is secured to a further substrate layer by the adhesive layer 5. As a result, the metal layers 8 are transferred to the further substrate layer, with their desired shape, particularly the delicate antenna structure, following the processing and the transfer. If the substrate layer 4 is then removed, the multilayer laminate 5 to 8 can be supplied with its shape to the target component. The unneeded part of the multilayer laminate outside of the punching shape of the punch remains on the first substrate layer 4 and is removed together with it—for example on a roll—without forming troublesome waste.

The invention therefore offers the very decisive advantage that only the specific part of the multilayer laminate that is also needed for the further process steps is punched out by the punching and transferring apparatus and supplied to the further processing. The remaining part (the scrap) of the multilayer laminate can be disposed of in a very simple manner, and there is no need to capture and dispose of individual layers, as in the prior art.

The multilayer laminate can comprise layers 4 to 8 as described above. However, more layers than this can be contemplated, as well as a multilayer laminate comprising only one substrate layer or adhesive layer and one further layer, in particular a metal layer, connected to each other via an adhesive layer. The metal layer 8 as above is advantageously used to produce an antenna and/or antenna structure, and therefore consists of an electrically conductive material (for example, aluminum foil). Depending on the intended use, the metal layer described above can also consist of a non-conductive material (such as a fabric, paper, plastic film, or the like).

The invention claimed is:

1. A method of operating a punching and transferring apparatus for making RFID antennas, wherein the punching and transferring apparatus has a punch with a vacuum connection that works together with a porous elastomer in such a manner that a desired shape is punched out of a multilayer laminate and held by the punch, and then can be released by a modification of the shape of the porous elastomer or of the vacuum.

2. The method according to claim 1, wherein the multilayer laminate comprises a first substrate layer and at least one second substrate layer connected to each other by a separable first adhesive layer, and the at least one second substrate layer is connected to a metal layer via a second adhesive layer, the desired shape being punched out of all the layers by the punch with the exception of the first substrate layer.

3. The method according to claim 1, wherein, prior to the punching of the multilayer laminate, a recess is created by an upstream punching process.

4. The method according to claim 1, wherein, prior to the punching process, the second substrate layer is separated from the first substrate layer and is then reattached.

5. The method according to claim 4, wherein the process of reattaching the two substrate layers is performed with a matched superimposition or with an offset.

6. The method according to claim 1, wherein the punched-out laminated piece comprising the substrate layer, the adhesive layers, and the metal layer is pressed onto a further substrate layer by the adhesive layer.

7. The method according to claim 1 wherein waste around the punched-out laminated piece is disposed of by winding around a roll.

8. The method according to claim 1, wherein waste around the punched-out laminated piece remains on the first substrate layer due to the first adhesive layer, and is disposed of with same by winding into a roll.

9. A method comprising:

providing a laminate comprised of a backing substrate, a layer of adhesive thereon, and an inlay layer secured by the adhesive layer to the backing substrate;

pressing a punch having a cavity defined within an annular cutting edge and holding a block of a porous elastomer against the laminate to cut with the edge through all of the laminate except the backing substrate and thereby punch out of the laminate a piece shaped like the cavity while simultaneously;

drawing air into the cavity through the porous elastomer to compact the elastomer and hold the punched-out piece in the cavity, against a front face of the block, and at or behind a plane defined by the edge;

thereafter separating the punched out piece from the backing substrate;

thereafter relaxing the block to elastically push at least part of the adhesive layer out of the cavity past the plane defined by the cutting edge; and pressing the adhesive layer on the punched-out piece against a target component to adhere the punched out piece thereto.

10. A punching and transferring apparatus for making an RFID inlay, the punching and transferring apparatus comprising:

a punch with a vacuum connection that works together with a porous elastomer in such a manner that a desired shape is punched out of a multilayer laminate and held by the punch and then can be released by a modification of the shape of the porous elastomer.

11. A punching and transferring apparatus for making an RFID inlay, the punching and transferring apparatus comprising:

a punch with a vacuum connection that works together with a porous elastomer, the punch having a cutting angle oriented symmetrically or asymmetrically, that is less than 45°.

12. The punching and transferring apparatus according to claim 11, wherein a flank of the punch extends parallel to a punching direction.

* * * * *